US010221632B2

(12) United States Patent
Macdonald et al.

(10) Patent No.: US 10,221,632 B2
(45) Date of Patent: Mar. 5, 2019

(54) COMPOSITE ISOLATION JOINT FOR GAP SUB OR INTERNAL GAP

(71) Applicant: GE Energy Oilfield Technology, Inc., Farnborough (GB)

(72) Inventors: Craig Macdonald, Houston, TX (US); Mark Miller, Houston, TX (US)

(73) Assignee: GE ENERGY OILFIELD TECHNOLOGY, INC, Houston, TX (US)

( * ) Notice: Subject to any disclaimer, the term of this patent is extended or adjusted under 35 U.S.C. 154(b) by 363 days.

(21) Appl. No.: 14/169,399

(22) Filed: Jan. 31, 2014

(65) Prior Publication Data

US 2014/0265304 A1 Sep. 18, 2014

Related U.S. Application Data

(60) Provisional application No. 61/781,821, filed on Mar. 14, 2013.

(51) Int. Cl.
*E21B 17/00* (2006.01)
*E21B 47/12* (2012.01)

(52) U.S. Cl.
CPC ..... *E21B 17/003* (2013.01); *E21B 47/122* (2013.01)

(58) Field of Classification Search
CPC .... E21B 17/003; E21B 17/028; E21B 17/023; E21B 47/022; E21B 47/122
(Continued)

(56) References Cited

U.S. PATENT DOCUMENTS 2,300,823 A * 11/1942 Whitman ..... E21B 25/02 175/232
2,536,216 A * 1/1951 Powell ..... E21B 17/073 285/114
(Continued)

FOREIGN PATENT DOCUMENTS

CA 2260307 C * 12/2003 ..... E21B 17/003
CA 2420402 A1 * 8/2004 ..... E21B 17/003
(Continued)

OTHER PUBLICATIONS

International Search Report and Written Opinion from related PCT application PCT/US2014/014057 dated Apr. 23, 2014 (12 pages).
(Continued)

*Primary Examiner* — Babajide A Demuren
(74) *Attorney, Agent, or Firm* — GE Global Patent Operation

(57) ABSTRACT

A non-conductive composite insert is provided between conductive portions, useful, for example, in downhole EM telemetry applications as an external "gap sub" in a drill collar, or as a sonde-based internal gap. In a preferred embodiment, the composite is made from a glass-fiber reinforced plastic, and separates non-magnetic conductive portions made from stainless steel. The composite insert provides a slanted or tapered transition into the conductive portions at either or both ends of the insert. The transitions on the composite insert may comprise one or more tapered surfaces, which may be male or female in configuration with respect to matching transitions on the conductive portions. The transitions may be bonded together by adhesive, or alternatively may be threaded.

19 Claims, 3 Drawing Sheets

(58) Field of Classification Search
USPC ..... 285/47, 48, 49, 50, 53, 54, 397, 398
See application file for complete search history.

(56) References Cited

U.S. PATENT DOCUMENTS 3,786,878 A * 1/1974 Chapman ..... E21B 17/18 175/106
4,399,877 A * 8/1983 Jackson ..... E21B 7/046 166/65.1
4,496,174 A 1/1985 McDonald et al.
6,050,353 A * 4/2000 Logan ..... E21B 17/003 175/320
6,439,324 B1 8/2002 Ringgenberg
6,634,427 B1 * 10/2003 Turner ..... E21B 17/18 166/242.3
2002/0075114 A1 * 6/2002 Hall ..... E21B 17/028 336/192
2002/0112852 A1 * 8/2002 Floerke ..... E21B 17/028 166/65.1
2002/0135179 A1 * 9/2002 Boyle ..... E21B 17/028 285/21.1
2003/0156918 A1 * 8/2003 Benedict ..... E21B 17/042 411/81
2004/0206510 A1 10/2004 Fraser et al.
2004/0219831 A1 * 11/2004 Hall ..... E21B 17/028 439/578
2005/0068703 A1 3/2005 Dopf et al.
2005/0103527 A1 * 5/2005 Church ..... E21B 7/068 175/62
2005/0285706 A1 * 12/2005 Hall ..... E21B 17/028 336/132
2006/0066301 A1 * 3/2006 Radzinski ..... E21B 47/122 324/222
2006/0201717 A1 * 9/2006 Cramer ..... E21B 17/028 175/320
2007/0159351 A1 * 7/2007 Madhavan ..... E21B 17/003 340/855.1
2008/0003856 A1 * 1/2008 Hall ..... E21B 4/145 439/191
2008/0191900 A1 * 8/2008 Camwell ..... E21B 17/028 340/854.3
2009/0101328 A1 * 4/2009 Leslie ..... E21B 17/003 166/65.1
2010/0043229 A1 2/2010 Camwell et al.
2012/0125686 A1 * 5/2012 Hogseth ..... E21B 17/003 175/40
2012/0228876 A1 * 9/2012 Samuel ..... E21B 41/0085 290/52
2013/0319767 A1 * 12/2013 Wilson ..... E21B 21/10 175/24

FOREIGN PATENT DOCUMENTS

EP 0964134 A2 12/1999
WO WO 9641931 A2 * 12/1996
WO 2010094978 A1 8/2010
WO WO 2011016810 A1 * 2/2011 ..... E21B 17/028
WO WO 2012115717 A2 * 8/2012 ..... B82Y 30/00

OTHER PUBLICATIONS

Search Report and Written Opinion issued in connection with corresponding EP Application No. 14765184.8 dated Oct. 12, 2016.

* cited by examiner

COMPOSITE ISOLATION JOINT FOR GAP SUB OR INTERNAL GAP

RELATED APPLICATIONS

This application claims the benefit of, and priority to, commonly-invented and commonly-assigned U.S. Provisional Application Ser. No. 61/781,821 filed Mar. 14, 2013.

FIELD OF THE INVENTION

This disclosure is directed generally to technology useful in measurement-while-drilling ("MWD") applications in the oil and gas exploration field, and more specifically to isolation technology in electromagnetic ("EM") telemetry.

BACKGROUND OF THE INVENTION

Ultra-low frequency (ULF) electromagnetic (EM) waves are the preferred transmission mechanism for wireless subterranean telemetry applications due to the ULF wave's ability to propagate long distances through the Earth's strata. In a typical subterranean telemetry application, the desired telemetry information is digitally encoded into data packets and sent as modulated "bursts" of ULF carrier waves. Transmission of the carrier waves is physically facilitated by injecting a modulated current into the Earth media using a power amplifier to create a time-varying voltage potential between two transmit electrodes coupled to the Earth media. The electrodes are spaced such that the induced current traverses a section of the Earth media creating associated electric and magnetic field energy which radiates as time-varying wave fronts through the Earth media.

According to a conventional EM telemetry system, a lower portion of drill string is electrically isolated from the upper portion, permitting the electrically-isolated lower portion to act as an antenna to transmit or receive ULF carrier waves to or from the surface through the Earth's strata. Transmission and reception by the antenna is enabled by circuitry within a transceiver located in the lower drill string portion below the point of electrical isolation. The transceiver is conventionally deployed in an antenna sub located just below the point of electrical isolation. In receive mode, the transceiver is connected to the lower drill string portion acting as an antenna that is electrically isolated from the surface. The transceiver may thus receive EM waves propagated from the surface through the Earth's strata. In transmit mode, the transceiver's tendency is to want to transmit using the entire drill string as an antenna. However, EM waves propagated by the transceiver are forced to "jump" the point of electrical isolation by passing through the surrounding Earth media. In so doing, the EM waves are thus forced to propagate through the Earth's media, where they may be received by the surface antennae. The EM system may therefore enable tools on the drill string to intercommunicate with the surface via encoded data packets modulated onto the transceived carrier waves.

In order for the lower drill string portion to efficiently function as an antenna, the lower portion should be electrically isolated from the upper portion as completely as possible. Any loss in complete electrical isolation will cause the lower drill string to start to lose its character as an antenna, reducing the effectiveness of the EM system in communicating via the Earth's strata. This need for as complete an electrical isolation as possible is magnified in view of the "reality" of the high impedance of the Earth's strata through which the carrier waves must pass in normal operational mode. In order to encourage robust wave propagation through the Earth's strata (and deter wave propagation losses to ground via the upper portion of the drill string), the impedance of the electrical isolation must be correspondingly even higher. It will be appreciated that complete electrical isolation is rarely achievable in practice. Most operational isolations will be "lossy" to some degree. A goal of electrical isolation of the drill string in EM telemetry is thus to reduce "lossiness" to as close to "no losses" as possible.

A further "reality" is that the EM waves transmitted by the transceiver on the drill string are likely to be weak in comparison to their counterparts transmitted from the surface because local power available to a transceiver on a tool string is limited. Thus, any wave propagation loss via poor isolation between upper and lower portions of the drill string is likely to cause a magnified reduction in effectiveness of the tool string transceiver's transmissions, as compared to surface transmissions.

At and around the desired point of isolation, the drill string often comprises an operational downhole tool structure deployed inside a hollow cylindrical outer collar. The collar generally refers to a string of concatenated hollow tubulars made from non-magnetic material, usually stainless steel. In this type of deployment, it is often advantageous to make separate but cooperating electrical breaks in both the tooling and in the collar itself in order to achieve overall electrical isolation of the entire drill string.

This electrical isolation of the upper and lower portions of the drill string is frequently enabled by placement of "gap sub" technology in the drill string at the point at which isolation is desired. The gap sub technology provides isolating structure to prevent, as completely as possible, any electrical conductivity through the drill string between the portions of the drill string above and below the gap sub technology.

This disclosure uses the term "gap sub technology" in the previous paragraph because in alternative deployments, the electrical isolation of the upper and lower portions of the drill string may be achieved using differing arrangements. For example, electrical isolation may be enabled by deploying, in one or more locations on the drill string, a single integrated electrical break which is integrated and continuous across both the tubular drill collar and the tooling within the drill collar. In other arrangements, as noted above, electrical isolation may be enabled via separate but cooperating electrical breaks: one (or more) electrical break(s) on the tubular drill collar, plus one (or more) separate electrical break(s) within the tooling structure deployed inside the collar. This disclosure pertains to the latter arrangement, in which the electrical isolation of the internal structure is separate from the electrical isolation of the drill collar itself.

On the collar itself, a "gap sub" is provided, comprising a hollow tubular inserted in the concatenation of hollow tubulars that comprise the collar. The concatenated connections of the collar are conventionally pin and box threaded connections, and the collar itself is conventionally a non-magnetic material (usually stainless steel). The gap sub is conventionally a non-magnetic tubular with pin and box connections at either end, configured to be inserted at a desired position in a concatenated string of similarly-connected non-magnetic drill collar tubulars. The collar itself is a portion of the overall drill string. Functionally, therefore, the gap sub electrically isolates the portions of the drill collar (and therefore, by extension, the entire drill string) above and below the gap sub.

Similarly, inside the collar, an "internal gap" is used for electrical isolation of the internal tooling structure. It is usually positioned just above the transceiver tooling. The internal gap electrically isolates the drill collar internals below the internal gap from the drill collar internals above the internal gap. Advantageously, the internal gap is also positioned as close to the external gap sub as is feasible, in order not to separate the internal gap and external gap too far within the drill string. When internal and external gaps are separated, the quality of the "jump" of EM transmissions across the gap and into the surrounding formation may be compromised.

The prior art describes various gap subs and internal gaps. For example, threaded isolation joints with ceramic-coated threads can be used to electrically isolate the drill collar. While serviceable, the durability and electrical performance of these types of isolation joints, especially in harsh environments, can be improved upon.

This disclosure is directed to an improved electrical isolation structure that provides excellent (almost complete) electrical isolation of the drill string above and below its location. Embodiments of this structure have demonstrated excellent performance in operating conditions historically known to cause the isolating structure of prior art gaps to break down or fail (e.g., high-vibration environments). These failures can cause unacceptable loss of isolation, and corresponding loss in EM telemetry, during live drilling operations. While originally conceived for electrical isolation of the drill collar (i.e., via an external "gap sub"), additional embodiments of the inventive content disclosed here have proved themselves also suitable for electrical isolation of the internal portions of the drill string (i.e., as an "internal gap").

SUMMARY OF THE INVENTION

The inventive content of this disclosure addresses one or more of the above-described drawbacks of the prior art. A gap sub is provided comprising an isolation joint including a composite insert. The composite is made from a non-electrically-conductive material such as glass-fiber reinforced plastic. Disclosed embodiments include use of, for example, a proprietary composite available from Advanced Composite Products & Technology, Inc. of Huntingdon Beach, Calif., as "DWG 3995 REV A", although the inventive material in this disclosure is not limited in anyway to use of this specific composite.

The composite insert provides a tapered transition into the conductive portions of the gap sub (typically made of metal) at either or both ends of the insert. The transitions on the composite insert may comprise one or more tapered surfaces, which may be male or female in configuration with respect to a matching transition on the conductive portions of the gap sub. The composite insert is bonded to its matching conductive portions, preferably by gluing or threading. An optional protective sleeve may be deployed on the outer surface of the gap sub at the composite-to-metal interfaces to protect the transition and maintain a constant outer diameter on the collar or internal tooling. The protective sleeve may be made from materials such as plastic or metal, so long as the electrical isolation is preserved, and may be attached by any method typical in the field, such as gluing or threading.

In one aspect, a composite isolation joint is disclosed, comprising a hollow cylindrical member having first and second cylindrical steel portions at corresponding first and second ends. The first and second cylindrical steel portions are separated by a cylindrical non-conductive composite portion. The composite isolation joint further includes first and second transitions between the non-conductive composite portion and a corresponding one of the first and second steel portions. The first steel portion provides a threaded box connection at the first end of the cylindrical member, and the second steel portion provides a threaded pin connection at the second end of the cylindrical member. In preferred embodiments, at least one of the first and second transitions is suitable to be bonded together by adhesive.

In another aspect, a composite isolation joint is disclosed, comprising a hollow cylindrical member having first and second cylindrical steel portions at corresponding first and second ends. The cylindrical steel portions are separated by a cylindrical non-conductive composite portion. The composite isolation joint further includes first and second transitions between the non-conductive composite portion and a corresponding one of the first and second steel portions. The first and second transitions include at least one tapered interface between the non-conductive composite portion and its corresponding one of the first and second steel portions. The first steel portion provides a threaded box connection at the first end of the cylindrical member, and the second steel portion provides a threaded pin connection at the second end of the cylindrical member. In further embodiments, the tapered interfaces may further include external or internal tapered composite surfaces that mate with corresponding tapered steel surfaces.

In yet another aspect, a composite insert for use in the composite isolation joint is disclosed, comprising a hollow cylindrical member made from non-conductive composite. The insert has first and second tapered profiles at corresponding first and second ends. One or more of the first and second tapered profiles may include external or internal tapered composite surfaces, or both.

It is therefore a technical advantage of the disclosed gap sub to provide excellent (almost complete) drill collar isolation either side of the above-described electrically isolating composite joints. As noted, deployment of the composite isolating joint enables a robust electrical isolation either side of the joint. As a result, optimized EM wave propagation is provided back and forth through the Earth's strata between the lower drill string (i.e. below the gap sub) and the surface.

A further technical advantage of the disclosed gap sub is to provide sustained electrical isolation either side of the above-disclosed composite joints in a wide range of operating conditions. Modern directional drilling operations require the drill string to undergo bending loads and cyclic vibration loads as the borehole changes direction. Historically, these loads have been known to crack or fracture electrically isolating members deployed on previous gap subs, causing loss of isolation. However, the non-conductive composite inserts, as configured on the new electrical isolation joint disclosed herein, have been shown to be very robust, even when the gap sub is undergoing high operational stresses, such as high bending loads or vibrations. For example, one embodiment of the inventive content of this disclosure has been field tested via deployment in an air drilling job. The high-vibration environment of air drilling typically results in severe damage to electrical isolation joints employing ceramic coated threads. Premature failure of such ceramic coated joints has been observed when deployed in a high-vibration environment. By contrast, the disclosed composite isolation joint performed as designed and expected throughout the air drilling field test, providing improved performance and durability, even in harsh operating environments.

The disclosed inventive content also provides additional technical advantages. Because of its improved durability, the composite joint can become a consumable part rather than a serviced part. As a consumable item, users are not required to schedule service visits with vendors that are not readily available world wide. Further, improved durability and performance may reduce overall drill string downtime.

The foregoing has outlined rather broadly the features and technical advantages of the inventive disclosure of this application, in order that the detailed description of the embodiments that follows may be better understood. It will be appreciated by those skilled in the art that the specific embodiments disclosed may be readily utilized as a basis for modifying or designing other structures for carrying out the same general purposes of the inventive material set forth in this disclosure.

BRIEF DESCRIPTION OF THE DRAWINGS

For a more complete understanding of the embodiments described in this disclosure, and their advantages, reference is now made to the following detailed description taken in conjunction with the accompanying drawings, in which.

DETAILED DESCRIPTION

Figure 1A:
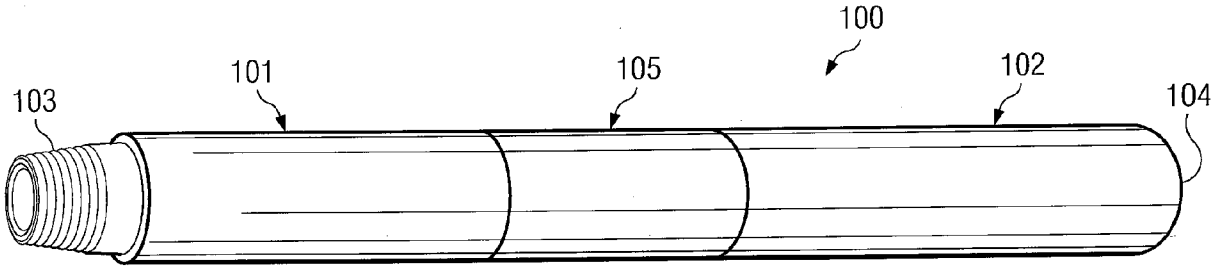
FIGS. 1A and 1B illustrate, in assembled and disassembled form respectively, perspective views of one embodiment of a gap sub including a non-conductive composite insert in accordance with the present disclosure.
Figure 1B:
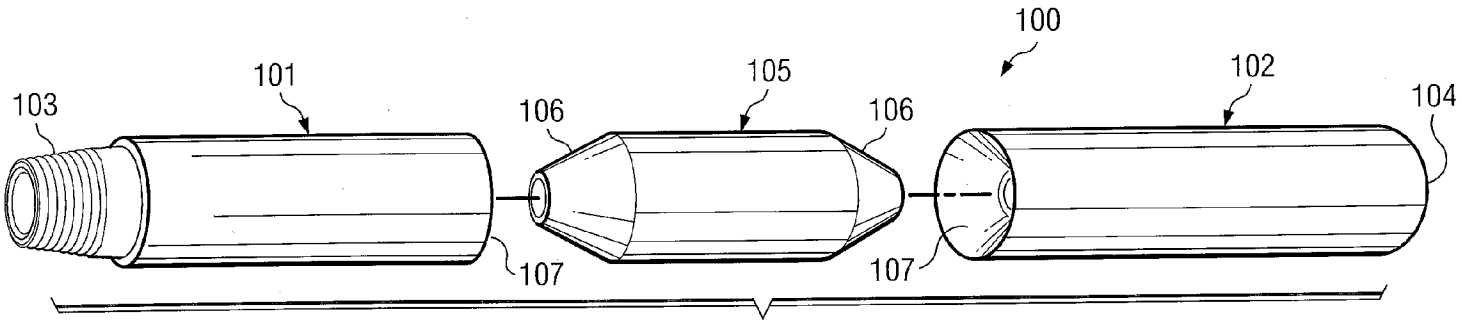

FIGS. 1A and 1B illustrate, in assembled and disassembled form respectively, perspective views of one embodiment of a composite isolation joint gap sub 100. In FIG. 1A, gap sub 100 comprises pin end portion 101 and box end portion 102 separated by composite portion 105. The pin end portion 101 and box end portion 102 are made from a conductive material, which may advantageously further be a non-magnetic material such as stainless steel (although the inventive material disclosed herein is not limited in this regard). The composite portion 105 is made from a non-conductive composite material, such as a glass-fiber reinforced plastic. Composite portion 105 may also be made from, for example, a proprietary composite available from Advanced Composite Products & Technology, Inc. of Huntingdon Beach, Calif., identifiable as "DWG 3995 REV A". It will be nonetheless appreciated that the inventive material in this disclosure is not limited in any way to use of this specific composite.

Fully assembled, as depicted in FIG. 1A, gap sub 100 is disposed to be inserted into the drill string. More, precisely, as described earlier in this disclosure, fully assembled gap sub 100 may be inserted into a concatenated string of non-magnetic drill collar tubulars. With further reference to FIG. 1A, conventional pin connection 103 and box connection 104 (hidden from view on FIG. 1A) at either end of fully assembled gap sub 100 enable its insertion into the concatenated string of drill collar tubulars. When inserted into the drill collar string, gap sub 100 provides electrical isolation within the drill collar either side of gap sub 100. The concatenated string of non-magnetic drill collar tubulars is in turn connected at either end to other (upper and lower) portions of the entire drill string. Gap sub 100 thus provides electrical isolation in the drill collar between the upper and lower portions of the entire drill string.

As noted, FIG. 1B illustrates gap sub 100 from FIG. 1A in disassembled form. All items called out by part number on FIG. 1A are illustrated on FIG. 1B by the same part number. Disassembly of gap sub 100 as shown in FIG. 1B allows further illustration of the composite portion 105. FIG. 1B shows composite portion 105 including external tapered surfaces 106 at each end, configured to be received into matching internal tapered surfaces 107 on pin end portion 101 and box end portion 102. As shown on FIG. 1B, external tapered surface 106 matches with internal tapered surface 107, creating a suitable interface for bonding (tapered surface 107 is hidden from view on pin end portion 101).

Nothing in this disclosure should be interpreted to place any limitation on the size, shape or geometry of the tapers on matching external and internal tapered surfaces 106 and 107. It will be appreciated that the dimensional specifics of the tapers may be varied to suit individual applications, responsive to parameters such as, for example, the dimensions and thicknesses of surrounding conductive portions, the electrical conductivity (or non-conductivity) and other electrical characteristics of the materials being used in the assembly, the characteristics of the bond (described further below), and the expected dynamic loads expected on the assembly in situ. However, for exemplary guidance only, it has been observed that serviceable results may be obtained when the tapers on matching external and internal tapered surfaces 106 and 107 are in a range of between 2 inches and 6 inches in longitudinal length when the corresponding outside diameter of the assembly is in a range of between 1.5 inches and 6.5 inches.

Any suitable commercially-available adhesive may be used to bond the transitions together. The adhesive may be selected to suit (1) the materials from which conductive and non-conductive portions being bonded are made, and (2) the most advantageous type of bond desired in view of anticipated service. In reference to item (2), it will be appreciated that different services may call for different types of bond. Parameters such as strength of bond, hardness and brittleness of bond, durability of bond in response to repetitive cyclic load, and chemical resistance of bond to harsh downhole environments are all examples of factors which may affect the type of bond (and thus the type of adhesive) selected. The foregoing list of parameters is not exhaustive. One adhesive that has proven to generate an operable "general purpose" bond in many downhole environments is a proprietary adhesive from Advanced Composite Products & Technology, Inc. of Huntingdon Beach, Calif., which may ordered from the supplier again by specifying "DWG 3995 REV A".

Figure 2B:
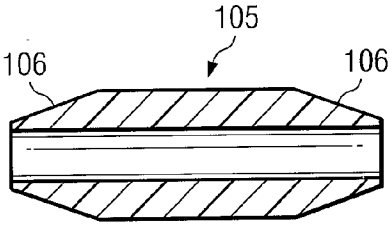
FIG. 2B is a section as shown on FIG. 2A.
Figure 2A:
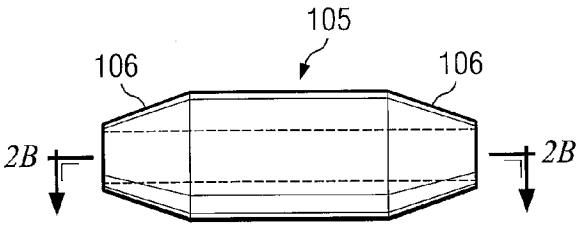
FIG. 2A is an elevation view of composite portion 105 isolated from FIG. 1B.
Figure 3B:
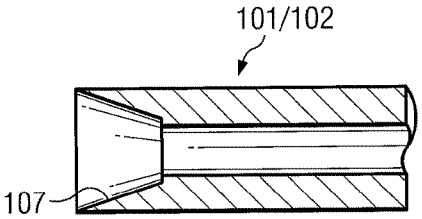
FIG. 3B is a section as shown on FIG. 3A.
Figure 3A:
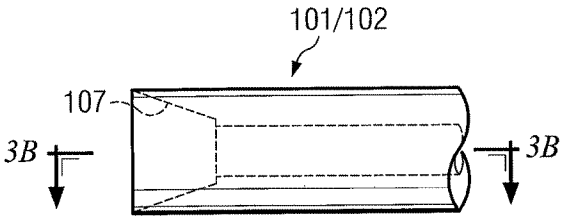
FIG. 3A is an elevation view of internal tapered surface 107 on pin end portion 101 or box end portion 102 isolated from FIG. 1B.

FIGS. 2A and 2B illustrate the embodiment of composite portion 105 in more detail. The detail of matching internal tapered surface 107 is illustrated in FIGS. 3A and 3B, omitting the pin or box ends of pin end portion 101 or box end portion 102 for clarity.

Field testing has shown that operational electrical isolation joints designed in accordance with this disclosure demonstrate excellent (almost complete) electrical isolation in normal directional drilling service. Further, when tested against a standard threaded isolation joint with ceramic-coated threads in a high-vibration environment, the standard joint failed after a short drilling run. In contrast, the disclosed composite gap completed the entire job without failing. Early field testing indicates that the disclosed composite gap has significantly better performance in harsh drilling environments and potentially may improve the service cycle time by at least a factor of four. Such improvements in service cycle times are likely to lead to improved running costs, and may further reduce down time losses. Consequently, in light of performance data, it is expected that this configuration, with a composite portion bonded to non-magnetic portions, is likely to enable superior performance.

Field testing has further shown that composite isolation joints designed in accordance with this disclosure also show good isolation performance (and limited damage to composites and bonds), even when placed under the high vibration and bending loads associated with elevated build rates.

Figure 4A:
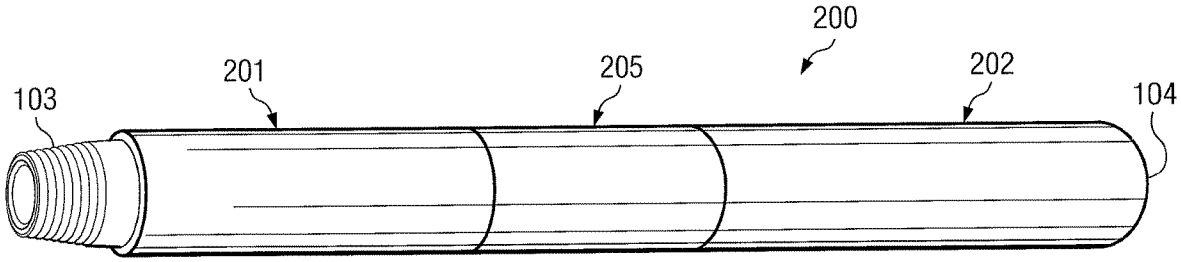
FIGS. 4A and 4B illustrate, in assembled and disassembled form respectively, perspective views of another embodiment of a gap sub including a non-conductive composite insert in accordance with the present disclosure.
Figure 4B:
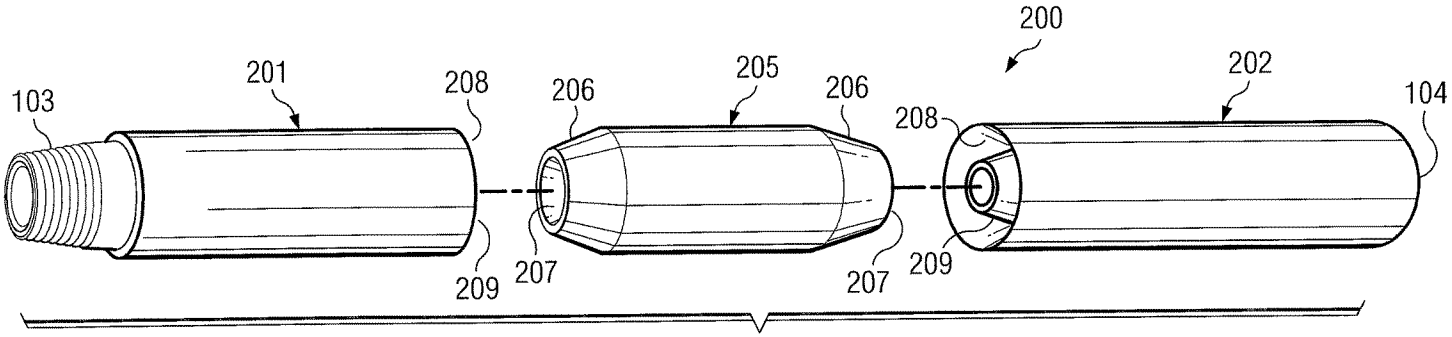

FIGS. 4A and 4B illustrate another embodiment of the disclosed composite isolation joint. Many features in the embodiment of FIGS. 4A and 4B are similar to the embodiment of FIGS. 1A and 1B. However, in the embodiment of FIGS. 4A and 4B, and as further illustrated on FIGS. 5A and 5B, gap sub 200 comprises composite portion 205 including both external tapered surface 206 and internal tapered surface 207 at both ends. Correspondingly, FIGS. 6A and 6B illustrate pin end portion 201 or box end portion 202 configured with matching internal tapered surfaces 208 and 209 for receiving and bonding to composite portion 205.

Providing two matching tapered surfaces increases the surface area for bonding composite portion 205 to pin end portion 201 or box end portion 202, which may improve the performance of the bond. While advantageous in some deployments, it may not be suitable for every application in the field. As noted above, different services may require different bonds. It will be appreciated that parameters such as the geometry of the transitions, the wall thickness of the composite isolation joint members, and the requirements of the particular operating environment are all examples of factors which may affect the number of tapered surfaces selected. The foregoing list of parameters is not exhaustive. Further, one adhesive that has proven to generate an operable "general purpose" bond suitable for use with the disclosed composite isolation joint in many downhole environments is a proprietary adhesive from Advanced Composite Products & Technology, Inc. of Huntingdon Beach, Calif., which may ordered from the supplier by specifying "DWG 3995 REV A".

Again, nothing in this disclosure should be interpreted to place any limitation on the size, shape or geometry of the tapers on tapered surfaces 206 through 209. As noted above, it will be appreciated that the dimensional specifics of the tapers may be varied to suit individual applications, responsive to parameters such as, for example, the dimensions and thicknesses of surrounding conductive portions, the electrical conductivity (or non-conductivity) and other electrical characteristics of the materials being used in the assembly, the characteristics of the bond (described further below), and the expected dynamic loads expected on the assembly in situ. However, for exemplary guidance only, it has been observed that serviceable results may be obtained when the tapers on tapered services 206 though 209 are in a range of between 2 inches and 6 inches in longitudinal length when the corresponding outside diameter of the assembly is in a range of between 1.5 inches and 6.5 inches.

FIGS. 4A and 4B provide, in assembled and disassembled form respectively, perspective views of the illustrated embodiment of a composite isolation joint gap sub 200. In FIG. 4A, gap sub 200 comprises pin end portion 201 and box end portion 202 separated by composite portion 205. The pin end portion 201 and box end portion 202 are made from a conductive material, which may advantageously further be a non-magnetic material such as stainless steel (although the inventive material disclosed herein is not limited in this regard). The composite portion 205 is made from a non-conductive composite material, such as a glass-fiber reinforced plastic. As with the embodiment of FIGS. 1A and 1B, composite portion 205 may also be made from, for example, a proprietary composite available from Advanced Composite Products & Technology, Inc. of Huntingdon Beach, Calif., identifiable as "DWG 3995 REV A". As noted above, however, it will be nonetheless appreciated that the inventive material in this disclosure is not limited in any way to use of this specific composite.

Fully assembled, as depicted in FIG. 4A, gap sub 200 is disposed to be inserted into the drill string in the manner also described above for gap sub 100. Similarly, FIG. 4B illustrates gap sub 200 from FIG. 4A in disassembled form. Items called out by part number on FIG. 4A are illustrated on FIG. 4B by the same part number. Disassembly of gap sub 200 as shown in FIG. 4B allows further illustration of composite portion 205. FIG. 4B shows composite portion 205 including external tapered surface 206 and internal tapered surface 207 at each end, configured to be received into matching internal tapered surfaces 208 and 209 on pin end portion 201 and box end portion 202. As shown on FIG. 4B, tapered surfaces 206 and 207 match with tapered surfaces 208 and 209, creating a suitable interface for bonding.

Figure 5B:
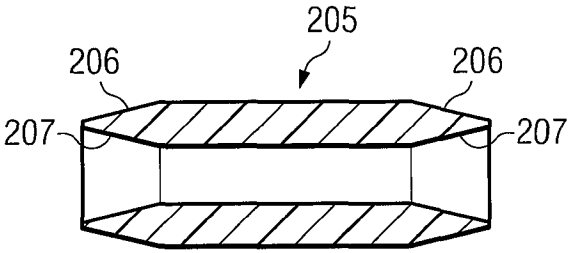
FIG. 5B is a section as shown on FIG. 5A.
Figure 6B:
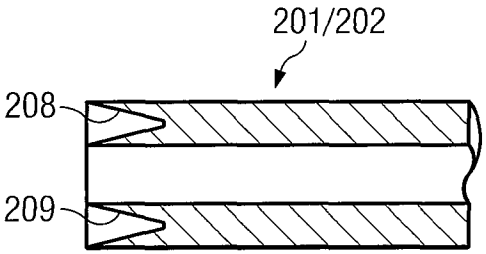
FIG. 6B is a section as shown on FIG. 6A.
Figure 5A:
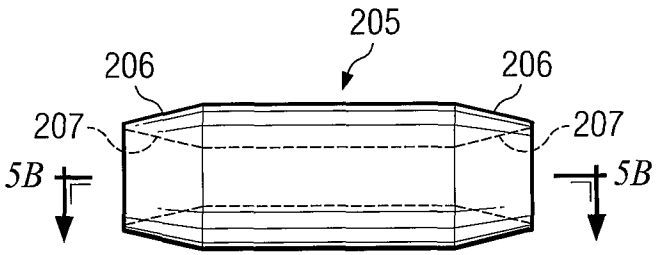
FIG. 5A is an elevation view of composite portion 205 isolated from FIG. 4B.
Figure 6A:
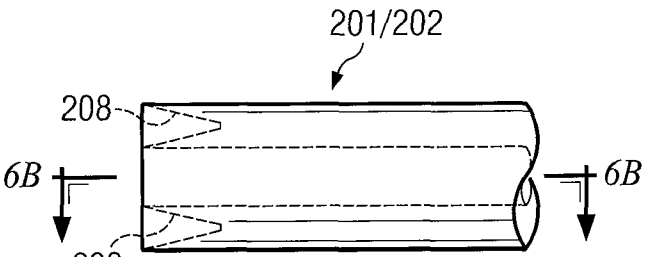
FIG. 6A is an elevation view of internal tapered surfaces 208 and 209 on pin end portion 201 or box end portion 202 isolated from FIG. 4B.

FIGS. 5A and 5B illustrate composite portion 205 on FIGS. 4A and 4B in more detail. The detail of matching internal tapered surfaces 208 and 209 is illustrated in FIGS. 6A and 6B, omitting the pin or box ends of pin end portion 201 or box end portion 202 for clarity.

The foregoing disclosure associated with FIGS. 1A through 6B has been directed to embodiments in which external "gap subs" have been illustrated. It will nonetheless be appreciated that the inventive material of this disclosure is not limited in this regard. Configurations such as illustrated on FIGS. 1A through 6B may be equally well deployed as sonde-based internal gaps. It should be noted that internal gaps are generally smaller in diameter than the gap subs in drill collars that surround them. For that reason, the embodiment of FIGS. 1A through 3B, with the "single taper transition", may be more suitable for internal gaps in some deployments. However, the inventive material in this disclosure is not limited to deploying "single taper" transitions in internal gaps.

The following paragraphs describe further alternative embodiments which, although not illustrated, are considered within the scope of this disclosure and the inventive material described herein.

Additional embodiments of the inventive content disclosed in this application may provide transitions that feature "textured" mating surfaces including, crinkle-cut, scoring or cross-hatching to further increase the surface area for bonding or to provide a mechanical strength to the bond. The foregoing list of parameters is not exhaustive and it will be appreciated that some of these features (e.g., a "crinkle cut" surface) may require a press fit or other technique to create the bond.

The embodiments described in this disclosure depict "shoulderless" transitions between the cylindrical portions and tapered interface portions of composite inserts 105 and 205 as well as on the corresponding surfaces of the pin end and box end portions 101, 102, 201, and 202. Other embodiments of the composite insert may deploy one or more "shouldered" transitions.

It will be appreciated that throughout this disclosure, pin and box connections have been called out and identified according to the illustrated embodiments. Nothing herein should be interpreted, however, to limit this disclosure to require a pin connection or a box connection at a particular location. It will be understood that pin connections and box connections, as well as other fastening methods known in the field, may be deployed interchangeably on parts that thread together.

This disclosure has described embodiments of a gap sub in which the mating ends for insertion into the drill string are made entirely of a non-magnetic material (such as stainless steel). However, the scope of this disclosure is not limited to non-magnetic material. Rather, parts (or all) of the gap sub may alternatively be made of other serviceable materials (including magnetic materials such as carbon steel) with equivalent enabling effect.

Although the present invention and its advantages have been described in detail, it should be understood that various changes, substitutions and alternations can be made herein without departing from the spirit and scope of the invention as defined by the appended claims.

We claim:

1. A composite isolation joint, comprising:

a hollow cylindrical member having first and second cylindrical steel portions at corresponding first and second ends, the first and second cylindrical steel portions separated by a cylindrical non-conductive composite portion, wherein the cylindrical non-conductive composite portion comprises first and second tapered profiles at corresponding first and second ends thereof;

first and second transitions defined between the cylindrical non-conductive composite portion and a corresponding one of the first and second cylindrical steel portions, wherein the first and second transitions comprise textured mating surfaces to increase surface area for bonding, and wherein at least one of the first and second transitions is bonded together, wherein the textured mating surfaces comprise a surface selected from the group consisting of (a) crinkle-cut, (b) scoring, and (c) cross-hatching; and the first cylindrical steel portion providing a threaded box connection at the first end of the cylindrical member and the second cylindrical steel portion providing a threaded pin connection at the second end of the cylindrical member.

2. The composite isolation joint of claim 1, wherein at least one of the first and second transitions is slanted.

3. The composite isolation joint of claim 1, wherein at least one of the first and second transitions is bonded together by an adhesive.

4. The composite isolation joint of claim 1, wherein at least one of the first and second transitions is threaded together.

5. The composite isolation joint of claim 1, further comprising a protective sleeve over at least one of the first and second transitions.

6. The composite isolation joint of claim 5, wherein the protective sleeve comprises a material selected from the group consisting of (a) metal, and (b) plastic.

7. The composite isolation joint of claim 5, wherein the protective sleeve is attached to the hollow cylindrical member by an attachment selected from the group consisting of (a) gluing, and (b) threading.

8. A composite isolation joint, comprising:

a hollow cylindrical member having first and second cylindrical steel portions, wherein the first and second cylindrical steel portions are separated by a cylindrical non-conductive composite portion;

first and second transitions defined between the cylindrical non-conductive composite portion and a corresponding one of the first and second cylindrical steel portions, wherein one of the first and second transitions comprise textured mating surfaces to increase surface area for bonding, wherein each of the first and second transitions include a tapered interface between the cylindrical non-conductive composite portion and its corresponding one of the first and second cylindrical steel portions, wherein another one of the first and second transitions between the cylindrical non-conductive composite portion and a corresponding one of the first and second cylindrical steel portions is smooth and, wherein at least one of the first and second cylindrical steel portions and the cylindrical non-conductive composite portion is bonded together, wherein the textured mating surfaces comprise a surface selected from the group consisting of (a) crinkle-cut, (b) scoring, and (c) cross-hatching;

the first cylindrical steel portion providing a threaded box connection at the first end of the cylindrical member; and the second cylindrical steel portion providing a threaded pin connection at the second end of the cylindrical member.

9. The composite isolation joint of claim 8, wherein at least one of the tapered interfaces further includes an external tapered composite surface mating with a corresponding internal tapered steel surface.

10. The composite isolation joint of claim 9, wherein the at least one of tapered interfaces further includes an external tapered composite surface mating with a corresponding first internal tapered steel surface and an internal tapered composite surface mating with a corresponding second internal tapered steel surface.

11. The composite isolation joint of claim 8, wherein at least one of the first and second transitions is bonded together by an adhesive.

12. The composite isolation joint of claim 8, wherein at least one of the first and second transitions is threaded together.

13. The composite isolation joint of claim 8, further comprising a protective sleeve over at least one of the first and second transitions.

14. The composite isolation joint of claim 13, wherein the protective sleeve comprises a material selected from the group consisting of (a) metal, and (b) plastic.

15. The composite isolation joint of claim 13, wherein the protective sleeve is attached to the hollow cylindrical member by an attachment selected from the group consisting of (a) gluing, and (b) threading.

16. A non-conductive composite insert for use in an isolation joint, comprising:

a hollow cylindrical member, the cylindrical member made from non-conductive composite, the cylindrical member providing first and second tapered profiles at corresponding first and second ends thereof, wherein at least one of the first and second tapered profiles includes an external tapered composite surface and an internal tapered composite surface, wherein at least one of the first and second tapered profiles is configured to be bonded to a steel portion, and wherein the first and second tapered profiles define textured mating surfaces to increase surface area for bonding, wherein the textured mating surfaces comprise a surface selected from the group consisting of (a) crinkle-cut, (b) scoring, and (c) cross-hatching.

17. The composite isolation joint of claim 1, wherein at least one end of the cylindrical non-conductive composite portion comprises an external tapered composite surface and an internal tapered composite surface configured to be bonded with one of the first and second cylindrical steel portions.

18. The composite isolation joint of claim 17, wherein at least one of an external tapered surface and an internal tapered surface of at least one of the first and second cylindrical steel portions is bonded, by an adhesive, to at least one of the external tapered composite surface or internal tapered composite surface of the cylindrical non-conductive composite portion.

19. The composite isolation joint of claim 1, wherein at least one of the first and second transitions comprises a tapered portion without threads of the non-conductive composite portion and a tapered portion without threads of at least one of the first and second cylindrical steel portions.

* * * * *